US006375599B1

(12) United States Patent
Brown

(10) Patent No.: US 6,375,599 B1
(45) Date of Patent: Apr. 23, 2002

(54) INFANT EXERCISER

(76) Inventor: William K. Brown, 11 Legions Way Bishops Stortford, Hertfordshire, London CM23 2AU (GB)

( * ) Notice: Subject to any disclaimer, the term of this patent is extended or adjusted under 35 U.S.C. 154(b) by 0 days.

(21) Appl. No.: 09/895,028

(22) Filed: Jun. 29, 2001

(51) Int. Cl.[7] ..... A63B 21/00; A47D 1/00

(52) U.S. Cl. ..... 482/51; 297/137; 482/148

(58) Field of Search ..... 482/68, 69, 51, 482/136, 146–147, 148; 297/137, 344.26; 248/372.1, 618

(56) References Cited

U.S. PATENT DOCUMENTS

| | | | | |
|---|---|---|---|---|
| 2,812,012 A | * | 11/1957 | Hansburg | 155/123 |
| 3,822,881 A | | 7/1974 | Douglass et al. | |
| 3,830,491 A | * | 8/1974 | Christians | 472/14 |
| D246,682 S | | 12/1977 | Nakao | |
| 4,743,008 A | | 5/1988 | Fermaglich et al. | |
| D335,044 S | | 4/1993 | Sutton | |
| 5,407,246 A | | 4/1995 | Meeker et al. | |
| 5,451,093 A | | 9/1995 | Petrie et al. | |
| 5,480,210 A | | 1/1996 | Lehenbauer et al. | |

* cited by examiner

*Primary Examiner*—S. Crow

(57) ABSTRACT

An infant exerciser includes a base plate, a turntable rotatably coupled to the base plate, and a mounting plate removably coupled to the turntable. A chair support assembly is coupled to the mounting plate. The chair support assembly receives a chair to couple the chair to the mounting plate. A foot actuating assembly is coupled to the mounting plate and is positioned adjacent the chair support assembly. The foot actuating assembly has a platform member for being actuated by feet of the infant when the infant is seated in the chair. A drive assembly is coupled to the mounting plate such that the foot actuating assembly is positioned between the chair support assembly and the drive assembly. The drive assembly is actuatable by the platform member and engages the base plate such that actuation of the drive assembly rotates the turntable with respect to the base plate.

18 Claims, 9 Drawing Sheets

INFANT EXERCISER

BACKGROUND OF THE INVENTION

1. Field of the Invention

The present invention relates to infant exercisers and more particularly pertains to a new infant exerciser for providing an infant with a form of exercise and entertainment.

2. Description of the Prior Art

The use of infant exercisers is known in the prior art. More specifically, infant exercisers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,480,210; U.S. Pat. No. 5,407,246; U.S. Pat. No. 3,822,881; U.S. Pat. No. 5,451,093; U.S. Pat. No. 4,743,008; U.S. Pat. No. Des. 335,044; and U.S. Pat. No. Des. 246,682.

While these devices fulfill their respective, particular objectives and requirements, the aforementioned patents do not disclose a new infant exerciser. The inventive device includes a base plate that is adapted for resting on a support surface. A turntable is rotatably coupled to the base plate such that the turntable rotates with respect to the base plate. A mounting plate is removably coupled to the turntable. A chair support assembly is coupled to an upper surface of the mounting plate. The chair support assembly is for receiving a chair such that the chair support assembly couples the chair to the mounting plate. The chair is adapted for holding an infant. A foot actuating assembly is coupled to the mounting plate such that the foot actuating assembly is positioned adjacent the chair support assembly. The foot actuating assembly has a platform member; the platform member is adapted for is actuated by feet of the infant when the infant is seated in the chair. A drive assembly is coupled to a front end of the mounting plate such that the foot actuating assembly is positioned between the chair support assembly and the drive assembly. The drive assembly is actuatable by the platform member of the foot actuating assembly and engaging the base plate such that actuation of the drive assembly by the foot actuating assembly rotates the turntable with respect to the base plate.

In these respects, the infant exerciser according to the present invention substantially departs from the conventional concepts and designs of the prior art, and in so doing provides an apparatus primarily developed for the purpose of providing an infant with a form of exercise and entertainment.

SUMMARY OF THE INVENTION

In view of the foregoing disadvantages inherent in the known types of infant exercisers now present in the prior art, the present invention provides a new infant exerciser construction wherein the same can be utilized for providing an infant with a form of exercise and entertainment.

The general purpose of the present invention, which will be described subsequently in greater detail, is to provide a new infant exerciser apparatus and method which has many of the advantages of the infant exercisers mentioned heretofore and many novel features that result in a new infant exerciser which is not anticipated, rendered obvious, suggested, or even implied by any of the prior art infant exercisers, either alone or in any combination thereof.

To attain this, the present invention generally comprises a base plate that is adapted for resting on a support surface. A turntable is rotatably coupled to the base plate such that the turntable rotates with respect to the base plate. A mounting plate is removably coupled to the turntable. A chair support assembly is coupled to an upper surface of the mounting plate. The chair support assembly is for receiving a chair such that the chair support assembly couples the chair to the mounting plate. The chair is adapted for holding an infant. A foot actuating assembly is coupled to the mounting plate such that the foot actuating assembly is positioned adjacent the chair support assembly. The foot actuating assembly has a platform member; the platform member is adapted for is actuated by feet of the infant when the infant is seated in the chair. A drive assembly is coupled to a front end of the mounting plate such that the foot actuating assembly is positioned between the chair support assembly and the drive assembly. The drive assembly is actuatable by the platform member of the foot actuating assembly and engaging the base plate such that actuation of the drive assembly by the foot actuating assembly rotates the turntable with respect to the base plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new infant exerciser apparatus and method which has many of the advantages of the infant exercisers mentioned heretofore and many novel features that result in a new infant exerciser which is not anticipated, rendered obvious, suggested, or even implied by any of the prior art infant exercisers, either alone or in any combination thereof.

It is another object of the present invention to provide a new infant exerciser, which may be easily and efficiently manufactured and marketed.

It is a further object of the present invention to provide a new infant exerciser, which is of a durable and reliable construction.

An even further object of the present invention is to provide a new infant exerciser which is susceptible of a low cost of manufacture with regard to both materials and labor, and which accordingly is then susceptible of low prices of sale to the consuming public, thereby making such infant exerciser economically available to the buying public.

Still yet another object of the present invention is to provide a new infant exerciser which provides in the apparatuses and methods of the prior art some of the advantages thereof, while simultaneously overcoming some of the disadvantages normally associated therewith.

Still another object of the present invention is to provide a new infant exerciser for providing an infant with a form of exercise and entertainment.

Yet another object of the present invention is to provide a new infant exerciser which includes a base plate that is adapted for resting on a support surface. A turntable is rotatably coupled to the base plate such that the turntable rotates with respect to the base plate. A mounting plate is removably coupled to the turntable. A chair support assembly is coupled to an upper surface of the mounting plate. The chair support assembly is for receiving a chair such that the chair support assembly couples the chair to the mounting plate. The chair is adapted for holding an infant. A foot actuating assembly is coupled to the mounting plate such that the foot actuating assembly is positioned adjacent the chair support assembly. The foot actuating assembly has a platform member; the platform member is adapted for is actuated by feet of the infant when the infant is seated in the chair. A drive assembly is coupled to a front end of the mounting plate such that the foot actuating assembly is positioned between the chair support assembly and the drive assembly. The drive assembly is actuatable by the platform member of the foot actuating assembly and engaging the base plate such that actuation of the drive assembly by the foot actuating assembly rotates the turntable with respect to the base plate.

Still yet another object of the present invention is to provide a new infant exerciser that would provide therapeutic value for children born or afflicted with physical conditions that compromise their strength and mobility. The present invention would provide a versatile unit use to stimulate the child while exercising the affected limbs.

Even still another object of the present invention is to provide a new infant exerciser that would offer great versatility providing the infant with varying types of stimulus. The unit could be used with the raised stand, allowing the child to view a number of visually stimulating sites as he or she rotates around in the seat. The present invention could be used on the floor, allowing the child to enjoy watching a video.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
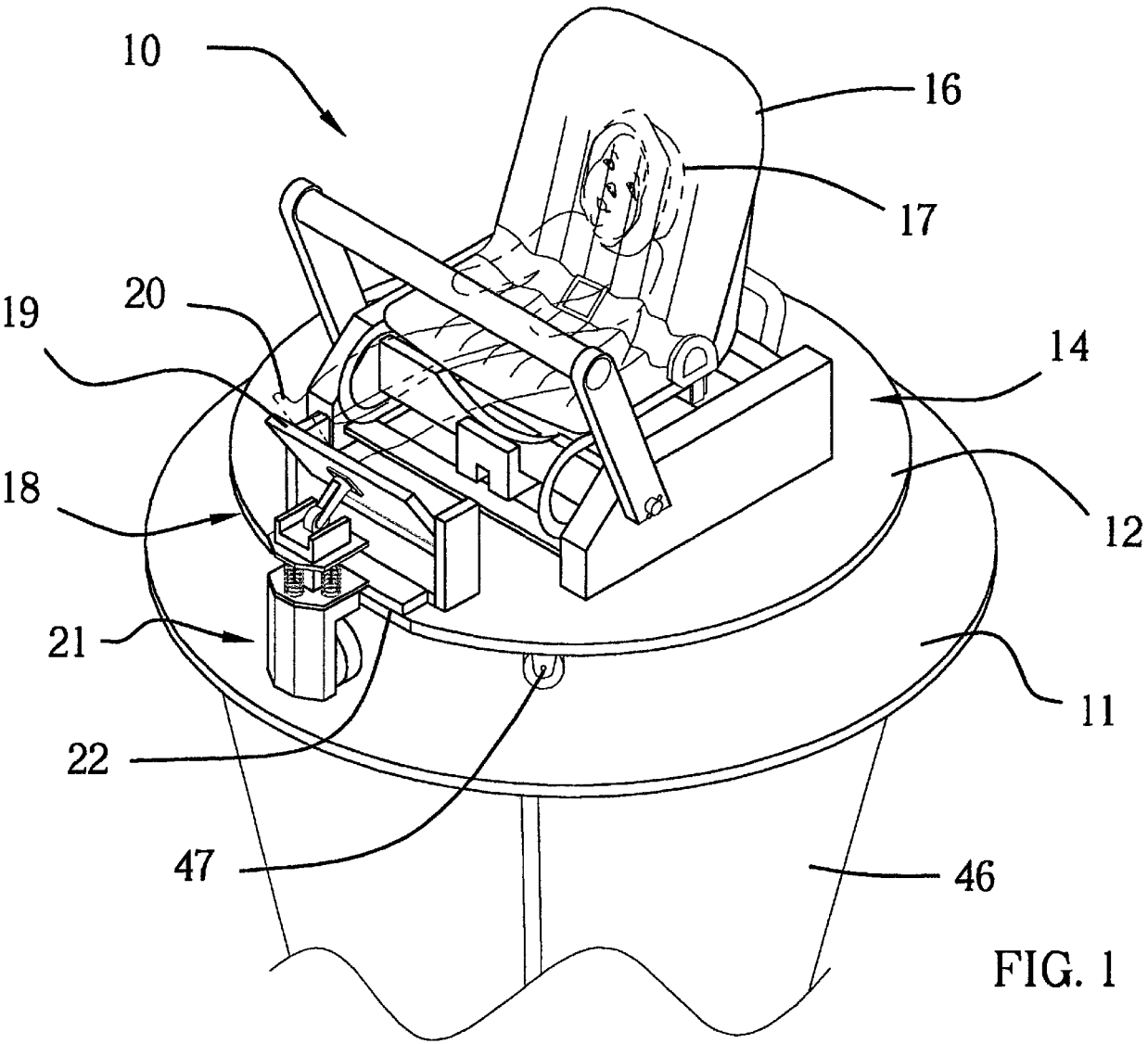
FIG. 1 is a perspective view of a new infant exerciser according to the present invention.
Figure 2:
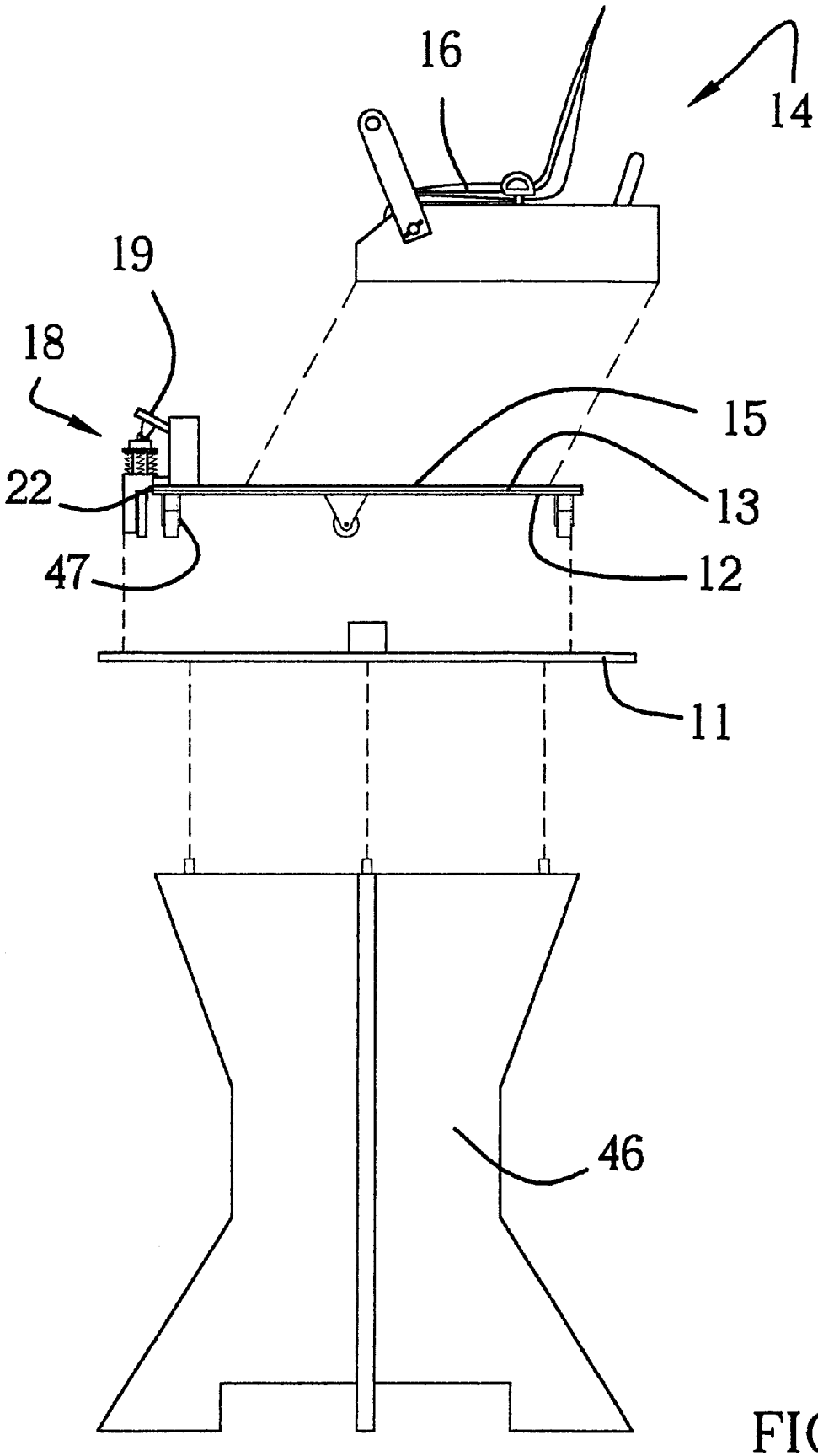
FIG. 2 is a side view of the present invention.
Figure 3:
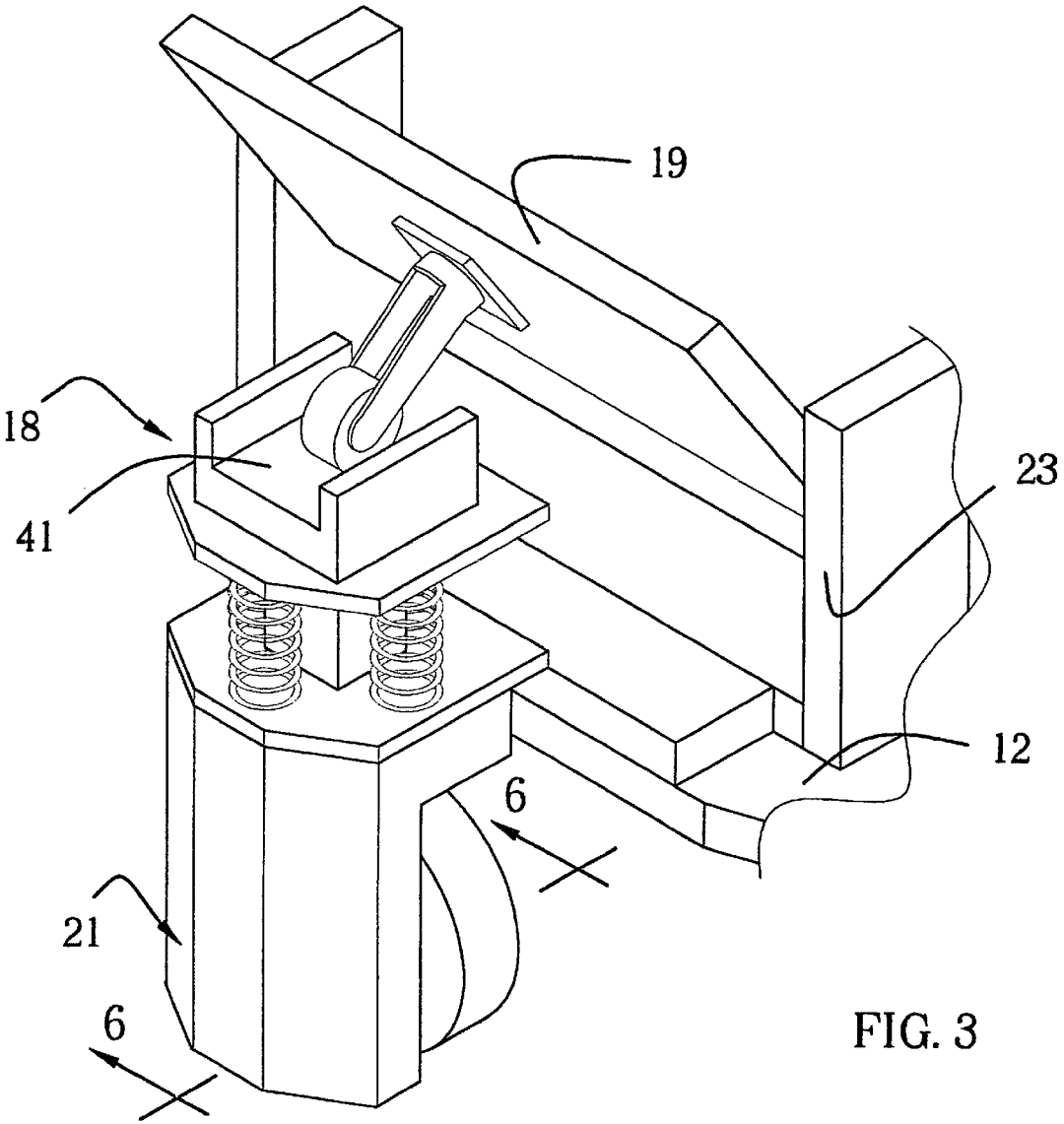
FIG. 3 is a perspective view of the present invention.
Figure 4:
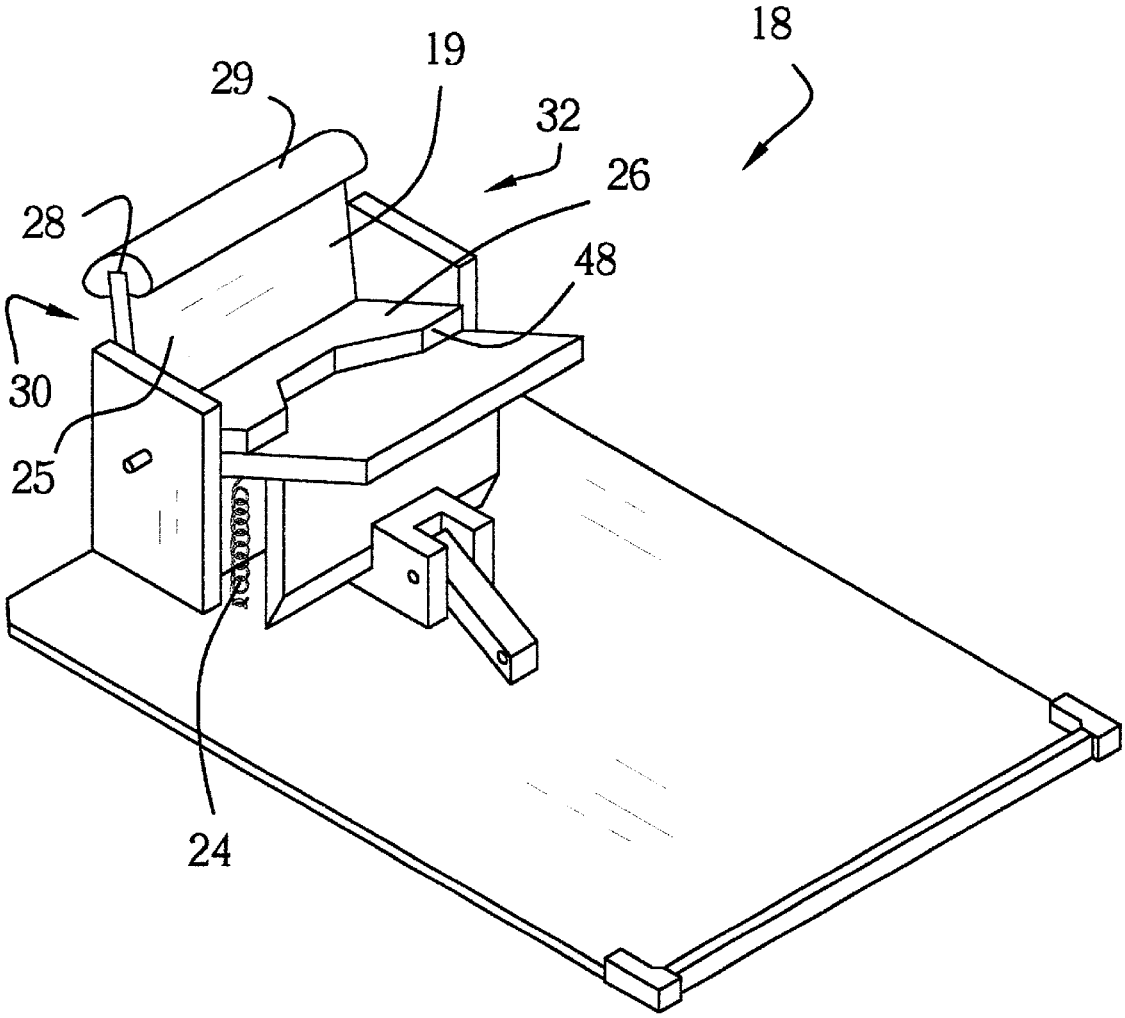
FIG. 4 is a perspective view of the present invention.
Figure 5:
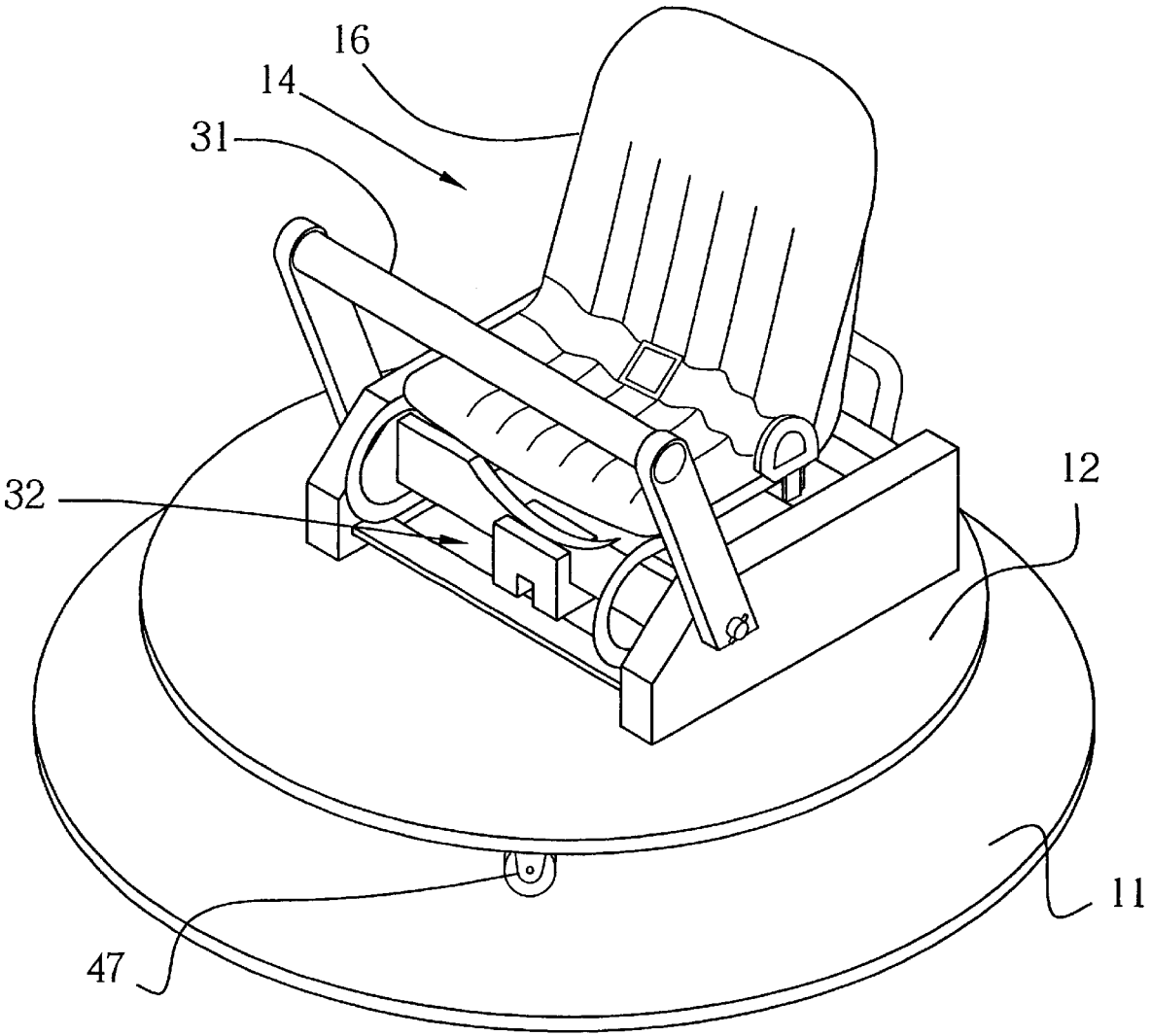
FIG. 5 is a perspective view of the present invention.
Figure 6:
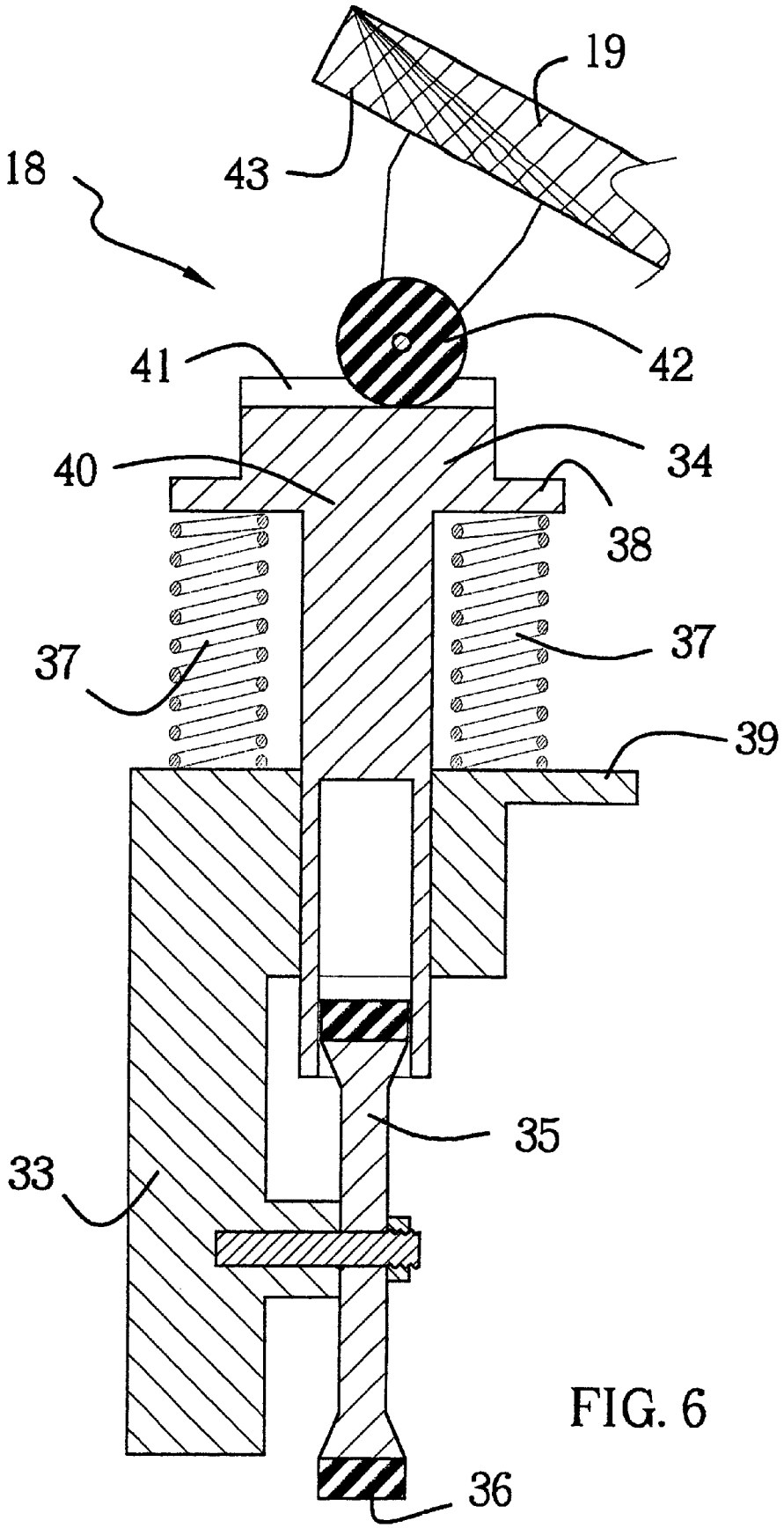
FIG. 6 is a cross-sectional view of the present invention.
Figure 7:
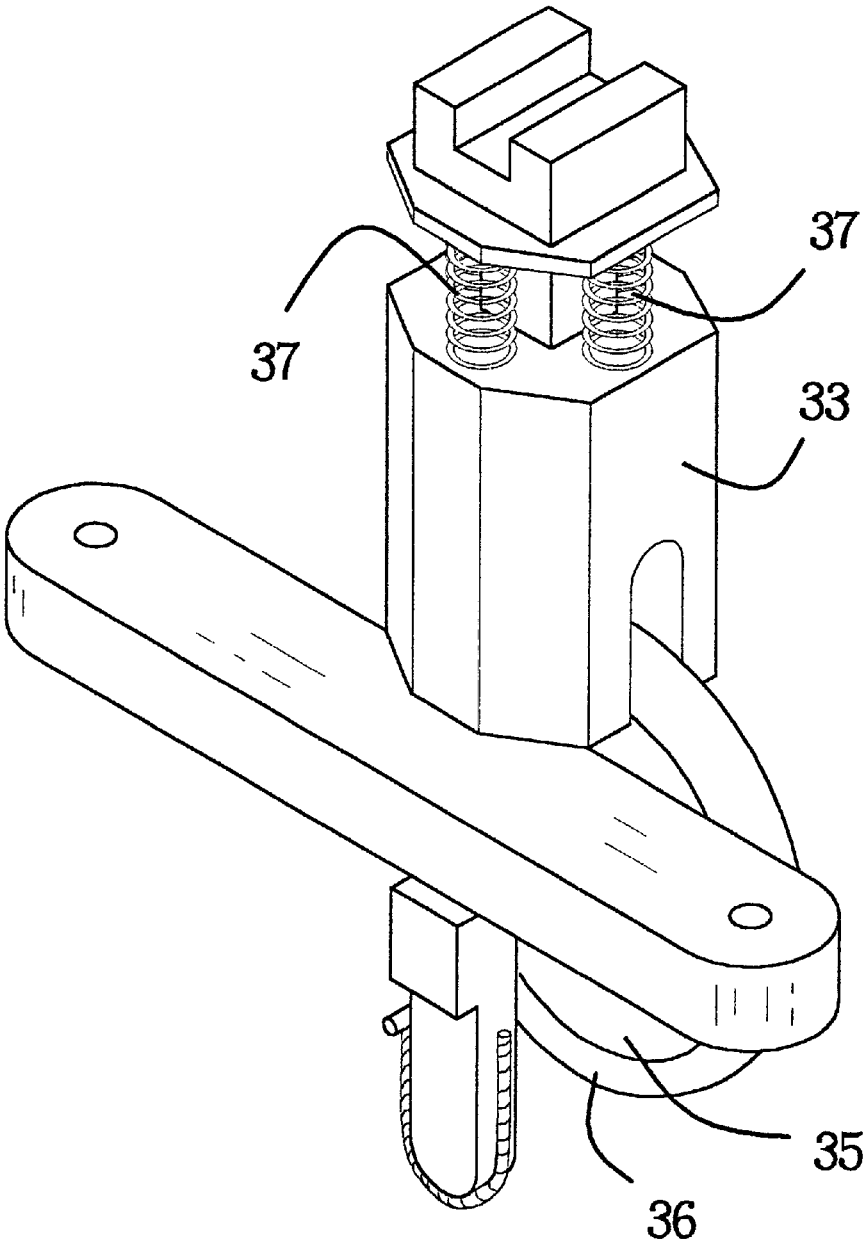
FIG. 7 is an end view of the present invention.
Figure 8:
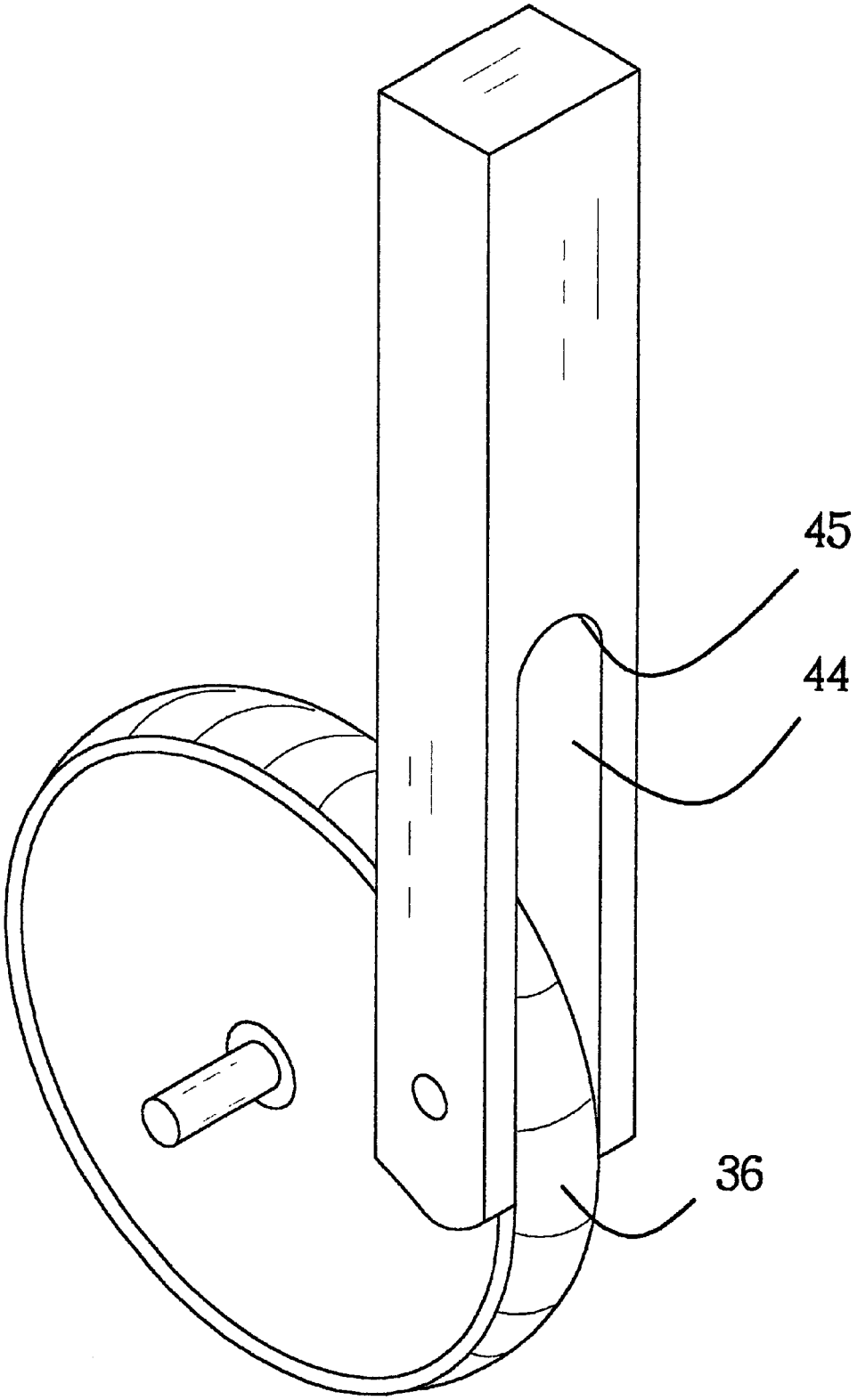
FIG. 8 is a side view of the present invention.
Figure 9:
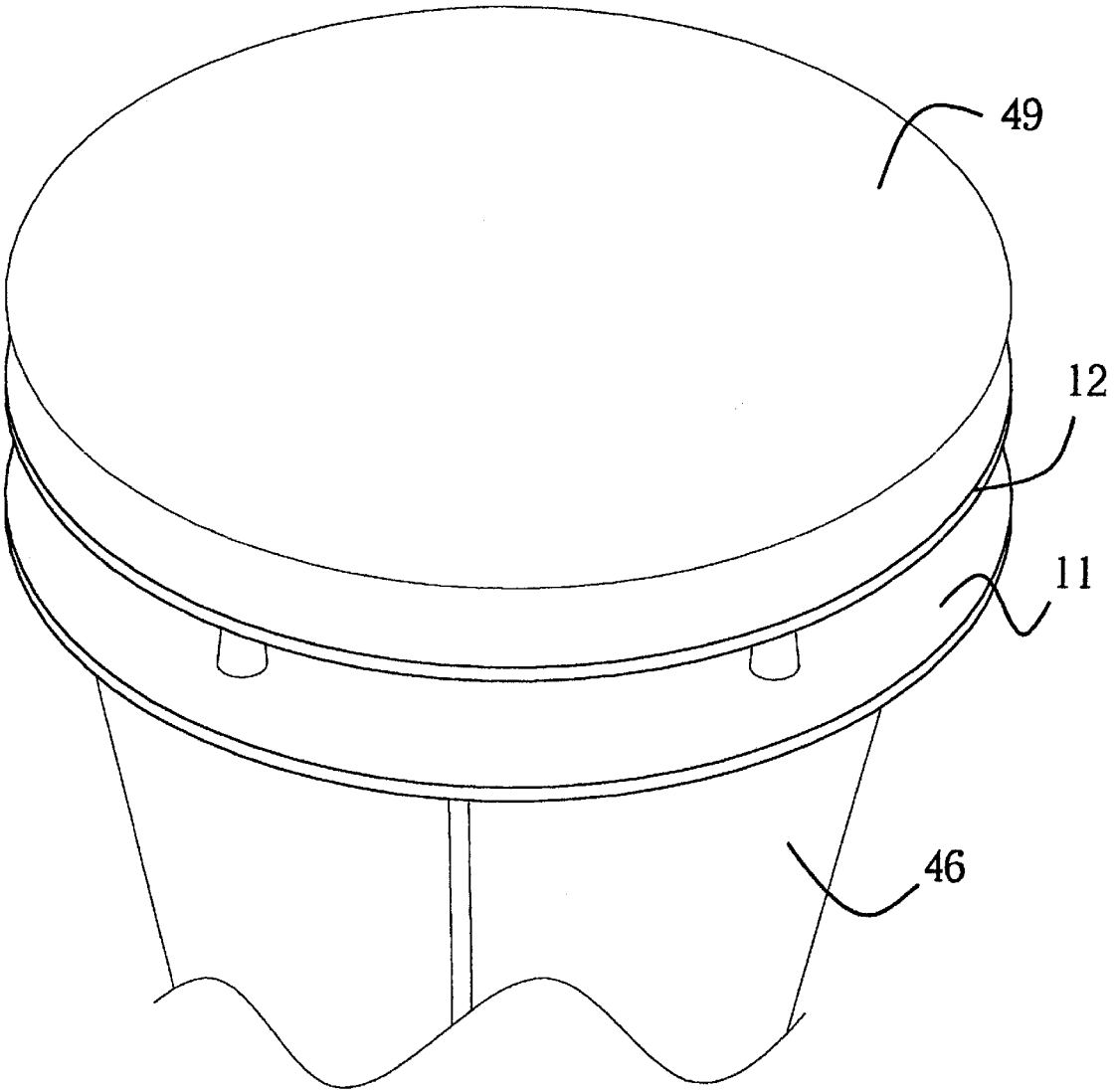
FIG. 9 is a top view of the present invention.

With reference now to the drawings, and in particular to FIGS. 1 through 9 thereof, a new infant exerciser embodying the principles and concepts of the present invention and generally designated by the reference numeral 10 will be described.

As best illustrated in FIGS. 1 through 9, the infant exerciser 10 generally includes a base plate 11 that is adapted for resting on a support surface. A turntable 12 is rotatably coupled to the base plate 11 such that the turntable 12 rotates with respect to the base plate 11. A mounting plate 13 is removably coupled to the turntable 12. A chair support assembly 14 is coupled to an upper surface 15 of the mounting plate 13. The chair support assembly 14 is for receiving a chair 16 such that the chair support assembly 14 couples the chair 16 to the mounting plate 13. The chair 16 is adapted for holding an infant 17. A foot actuating assembly 18 is coupled to the mounting plate 13 such that the foot actuating assembly 18 is positioned adjacent the chair support assembly 14. The foot actuating assembly 18 has a platform member 19, the platform member 19 is adapted for being actuated by the feet 20 of the infant 17 when the infant 17 is seated in the chair 16. A drive assembly 21 is coupled to a front end 22 of the mounting plate 13 such that the foot actuating assembly 18 is positioned between the chair support assembly 14 and the drive assembly 21. The drive assembly 21 is actuatable by the platform member 19 of the foot actuating assembly 18 and engaging the base plate 11 such that actuation of the drive assembly 21 by the foot actuating assembly 18 rotates the turntable 12 with respect to the base plate 11.

The foot actuating assembly 18 includes a frame 23. The platform member 19 is hingably coupled to the frame 23. The platform member 19 is adapted for supporting the feet 20 of the infant 17 such that the platform member 19 is pivotable with respect to the frame 23 when pressure is applied against the platform member 19 with the feet 20 of the infant 17, the platform member 19 is for actuating the drive assembly 21. The foot actuating assembly 18 has a plurality of biasing members 24 coupled to the platform member 19. The biasing members 24 are for biasing the platform member 19 into an upright position.

The platform member 19 has a foot portion 25 and a base portion 26. The foot portion 25 is adapted for being engaged by a bottom of the feet 20 of the infant 17. The base portion 26 extends outwardly from the foot portion 25 such that the base portion 26 is adapted for supporting a heel of the foot 20 of the infant 17.

The base portion 26 has a cut out 27 that extends inwardly from a rear edge 48 of the base portion 26. The cut out 27 is for preventing the base portion 26 from striking the legs of the user when the platform member 19 is rotated with respect to the frame 23 of the foot actuating assembly 18.

The foot portion 25 has free edge 28 opposite the base portion 26. A strike pad 29 is coupled to the free edge 28 of the foot portion 25. The strike pad 29 includes a shock absorbent material such that the strike pad 29 is adapted for absorbing the inadvertent impact of the free edge 28 of the foot portion 25 with a portion of a body of the infant 17.

A handle assembly 30 is pivotally coupled to the chair support assembly 14. The handle assembly 30 has a hand bar 31. The hand bar 31 is adapted for being gripped by the hands of an infant 17. The handle assembly 30 is operationally coupled to the foot actuating assembly 18 such that actuation of the foot actuating assembly 18 pivots the handle assembly 30 with respect to the chair assembly 14. The handle assembly 30 is adapted for exercising the hands and arms of the infant 17 by providing a rowing motion when the foot actuating assembly 18 is actuated.

A linkage assembly 32 coupled between the platform member 19 of the foot actuating assembly 18 and the handle assembly 30. The linkage assembly 32 is for transferring movement of the platform member 19 to the handle assembly 30.

The drive assembly 21 has a housing 33 and a drive arm 34. The housing 33 is coupled to the mounting plate 13. A drive wheel 35 is rotatably coupled to the housing 33. An outer surface 36 of the drive wheel 35 is for contacting the base plate 11. The drive arm 34 extends through the housing 33 and contacting the outer surface 36 of the drive wheel 35. The drive arm 34 is actuatable by the platform member 19 of the foot actuation assembly 18 such that the drive arm 34 is driven downwards by the platform member 19. The drive arm 34 pushes along the outer surface 36 of the drive wheel 35 thereby rotating the drive wheel 35 with respect to the housing 33 and rotating the turntable 12 with respect to the base plate 11. The drive assembly 21 has a plurality of compression members 37. The compression members 37 are positioned between the housing 33 and the drive arm 34 such that the compression members 37 are for biasing the drive arm 34 away from the drive wheel 35.

The drive arm 34 has a lip 38 that outwardly extends from the drive arm 34. The compression members 37 are positioned between the lip 38 of the drive arm 34 and a top face 39 of the housing 33. The drive arm 34 has a top end 40 that has a channel 41. The channel 41 is for receiving an actuation wheel 42 coupled to a back surface 43 of the platform member 19 of the foot actuation assembly 18. The actuation wheel 42 is for rolling along a length of the channel 41 such that the drive arm 34 is driven downwards when the platform member 19 of the foot actuation assembly 18 is pressed on by the feet 20 of the infant 17. The drive arm 34 includes a slot 44. The slot 44 is for receiving the drive wheel 35. A leading edge 45 of the slot 44 is for engaging the outer surface 36 of the drive wheel 35 such that the leading edge 45 pushes the outer surface 36 of drive wheel 35 whereby the drive wheel 35 is rotated with respect to the base plate 11. The outer surface 36 of the drive wheel 35 includes a friction enhancing material. The friction enhancing material is for reducing slippage of the drive arm 34 when the drive arm 34 pushes against the outer surface 36 of the drive wheel 35.

A pedestal 46 is removably couplable to the base plate 11. The pedestal 46 is for raising the base plate 11 a height from the support surface. A plurality of casters 47 is coupled to the turntable 12. The casters 47 are positioned between the turntable 12 and the base plate 11. The casters 47 are for supporting the turntable 12 on the base plate 11. The caster 47 is rotatable with respect to the base plate 11 such that the casters 47 roll across the base plate 11 when the turntable 12 is rotated with respect to the base plate 11.

In and embodiment the present invention includes a pad 49 that is removably coupled to the turntable 12 when the mounting plate 13 is removed from the turntable 12. The pad 49 is adapted for supporting the body of an infant.

In use, the infant pushes down with their feet on the foot actuating assembly, which in turn actuates the drive assembly, which rotates the turntable. The rotation also causes the drive assembly to cause the handle bar to row in a back and forth motion.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An infant exerciser for exercising and entertaining an infant, the infant exerciser comprising:

a base plate being adapted for resting on a support surface;

a turntable being rotatably coupled to said base plate such that said turntable rotates with respect to said base plate;

a mounting plate being removably coupled to said turntable;

a chair support assembly being coupled to an upper surface of said mounting plate, said chair support assembly being for receiving a chair such that said chair support assembly couples said chair to said mounting plate, said chair being adapted for holding an infant;

a foot actuating assembly being coupled to said mounting plate such that said foot actuating assembly is positioned adjacent said chair support assembly, said foot actuating assembly having a platform member, said platform member being adapted for being actuated by feet of the infant when the infant is seated in said chair; and a drive assembly being coupled to a front end of said mounting plate such that said foot actuating assembly is positioned between said chair support assembly and said drive assembly, said drive assembly being actuatable by said platform member of said foot actuating assembly and engaging said base plate such that actuation of said drive assembly by said foot actuating assembly rotates said turntable with respect to said base plate.

2. The infant exerciser as set forth in claim 1, wherein said foot actuating assembly comprises a frame, said platform member being hingably coupled to said frame, said platform member being adapted for supporting the feet of the infant such that said platform member is pivotable with respect to said frame when pressure is applied against said platform member with the feet of the infant, said platform member being for actuating said drive assembly.

3. The infant exerciser as set forth in claim 1, wherein said foot actuating assembly has a plurality of biasing members coupled to said platform member, said biasing members being for biasing said platform member into an upright position.

4. The infant exerciser as set forth in claim 1, wherein said platform member has a foot portion and a base portion, said foot portion being adapted for being engaged by a bottom of the feet of the infant, said base portion extending outwardly from said foot portion such that said base portion is adapted for supporting a heel of the foot of the infant.

5. The infant exerciser as set forth in claim 4, wherein said base portion has a cut out extending inwardly from a rear edge 48 of said base portion, said cut out being for preventing said base portion from striking the legs of the user when said platform member is rotated with respect to said frame of said foot actuating assembly.

6. The infant exerciser as set forth in claim 4, wherein said foot portion has free edge opposite said base portion, a strike pad being coupled to said free edge of said foot portion, said strike pad comprises a shock absorbent material such that said strike pad is adapted for absorbing the inadvertent impact of said free edge of said foot portion with a portion of a body of the infant.

7. The infant exerciser as set forth in claim 1, further comprising:

a handle assembly being pivotally coupled to said chair support assembly, said handle assembly having a hand bar, said hand bar being adapted for being gripped by hands of an infant, said handle assembly being operationally coupled to said foot actuating assembly such that actuation of said foot actuating assembly pivots said handle assembly with respect to said chair assembly, said handle assembly being adapted for exercising the hands and arms of the infant by providing a rowing motion when said foot actuating assembly is actuated.

8. The infant exerciser as set forth in claim 7, further comprising:

a linkage assembly coupled between said platform member of said foot actuating assembly and said handle assembly, said linkage assembly being for transferring movement of said platform member to said handle assembly.

9. The infant exerciser as set forth in claim 1, wherein said drive assembly has a housing and a drive arm, said housing being coupled to said mounting plate, a drive wheel being rotatably coupled to said housing, an outer surface of said drive wheel contacting said base plate, said drive arm extending through said housing and contacting said outer surface of said drive wheel, said drive arm being actuatable by said platform member of said foot actuation assembly such that said drive arm is driven downwards by said platform member whereby said drive arm pushes along said outer surface of said drive wheel thereby rotating said drive wheel with respect to said housing and rotating said turntable with respect to said base plate.

10. The infant exerciser as set forth in claim 9, wherein said drive assembly has a plurality of compression members, said compression members being positioned between said housing and said drive arm such that said compression members are for biasing said drive arm away from said drive wheel.

11. The infant exerciser as set forth in claim 10, wherein said drive arm has a lip outwardly extending from said drive arm, said compression members being positioned between said lip of said drive arm and a top face of said housing.

12. The infant exerciser as set forth in claim 9, wherein said drive arm has a top end has a channel, said channel being for receiving an actuation wheel coupled to a back surface of said platform member of said foot actuation assembly, said actuation wheel being for rolling along a length of said channel such that said drive arm is driven downwards when said platform member of said foot actuation assembly is pressed on by the feet of the infant.

13. The infant exerciser as set forth in claim 9, wherein said drive arm comprises a slot, said slot being for receiving said drive wheel, a leading edge of said slot being for engaging said outer surface of said drive wheel such that said leading edge pushes said outer surface of drive wheel whereby said drive wheel is rotated with respect to said base plate.

14. The infant exerciser as set forth in claim 9, wherein said outer surface of said drive wheel comprises a friction enhancing material, said friction enhancing material being for reducing slippage of said drive arm when said drive arm pushes against said outer surface of said drive wheel.

15. The infant exerciser as set forth in claim 1, further comprises:

a pad being removably couplable to said turntable when said mounting plate is removed from said turntable, said pad being adapted for supporting the body of an infant.

16. The infant exerciser as set forth in claim 1, further comprises:

a pedestal being removably couplable to said base plate, said pedestal being for raising said base plate a height from said support surface.

17. The infant exerciser as set forth in claim 1, further comprising:

a plurality of casters being coupled to said turntable, said casters being positioned between said turntable and said base plate, said casters being for supporting said turntable on said base plate, said caster being rotatable with respect to said base plate such that said casters roll across said base plate when said turntable is being rotated with respect to said base plate.

18. A infant exerciser for exercising and entertaining an infant, the infant exerciser comprising:

a base plate being adapted for resting on a support surface;

a turntable being rotatably coupled to said base plate such that said turntable rotates with respect to said base plate;

a mounting plate being removably coupled to said turntable;

a chair support assembly being coupled to an upper surface of said mounting plate, said chair support assembly being for receiving a chair such that said chair support assembly couples said chair to said mounting plate, said chair being adapted for holding an infant;

a foot actuating assembly being coupled to said mounting plate such that said foot actuating assembly is positioned adjacent said chair support assembly, said foot actuating assembly having a platform member, said platform member being adapted for being actuated by feet of the infant when the infant is seated in said chair;

a drive assembly being coupled to a front end of said mounting plate such that said foot actuating assembly is positioned between said chair support assembly and said drive assembly, said drive assembly being actuatable by said platform member of said foot actuating assembly and engaging said base plate such that actuation of said drive assembly by said foot actuating assembly rotates said turntable with respect to said base plate;

wherein said foot actuating assembly comprises a frame, said platform member being hingably coupled to said frame, said platform member being adapted for supporting the feet of the infant such that said platform member is pivotable with respect to said frame when pressure is applied against said platform member with the feet of the infant, said platform member being for actuating said drive assembly;

wherein said foot actuating assembly has a plurality of biasing members coupled to said platform member, said biasing members being for biasing said platform member into an upright position;

wherein said platform member has a foot portion and a base portion, said foot portion being adapted for being engaged by a bottom of the feet of the infant, said base portion extending outwardly from said foot portion such that said base portion is adapted for supporting a heel of the foot of the infant;

wherein said base portion has a cut out extending inwardly from a rear edge of said base portion, said cut out being for preventing said base portion from striking the legs of the user when said platform member is rotated with respect to said frame of said foot actuating assembly;

wherein said foot portion has free edge opposite said base portion, a strike pad being coupled to said free edge of said foot portion, said strike pad comprises a shock absorbent material such that said strike pad is adapted for absorbing the inadvertent impact of said free edge of said foot portion with a portion of a body of the infant;

wherein a handle assembly being pivotally coupled to said chair support assembly, said handle assembly having a hand bar, said hand bar being adapted for being gripped by hands of an infant, said handle assembly being operationally coupled to said foot actuating assembly such that actuation of said foot actuating assembly pivots said handle assembly with respect to said chair assembly, said handle assembly being adapted for exercising the hands and arms of the infant by providing a rowing motion when said foot actuating assembly is actuated;

wherein a linkage assembly coupled between said platform member of said foot actuating assembly and said handle assembly, said linkage assembly being for transferring movement of said platform member to said handle assembly;

wherein said drive assembly has a housing and a drive arm, said housing being coupled to said mounting plate, a drive wheel being rotatably coupled to said housing, an outer surface of said drive wheel contacting said base plate, said drive arm extending through said housing and contacting said outer surface of said drive wheel, said drive arm being actuatable by said platform member of said foot actuation assembly such that said drive arm is driven downwards by said platform member whereby said drive arm pushes along said outer surface of said drive wheel thereby rotating said drive wheel with respect to said housing and rotating said turntable with respect to said base plate;

wherein said drive assembly has a plurality of compression members, said compression members being positioned between said housing and said drive arm such that said compression members are for biasing said drive arm away from said drive wheel;

wherein said drive arm has a lip outwardly extending from said drive arm, said compression members being positioned between said lip of said drive arm and a top face of said housing;

wherein said drive arm has a top end has a channel, said channel being for receiving an actuation wheel coupled to a back surface of said platform member of said foot actuation assembly, said actuation wheel being for rolling along a length of said channel such that said drive arm is driven downwards when said platform member of said foot actuation assembly is pressed on by the feet of the infant;

wherein said drive arm comprises a slot, said slot being for receiving said drive wheel, a leading edge of said slot being for engaging said outer surface of said drive wheel such that said leading edge pushes said outer surface of drive wheel whereby said drive wheel is rotated with respect to said base plate;

wherein said outer surface of said drive wheel comprises a friction enhancing material, said friction enhancing material being for reducing slippage of said drive arm when said drive arm pushes against said outer surface of said drive wheel;

wherein a pedestal being removably couplable to said base plate, said pedestal being for raising said base plate a height from said support surface; and wherein a plurality of casters being coupled to said turntable, said casters being positioned between said turntable and said base plate, said casters being for supporting said turntable on said base plate, said caster being rotatable with respect to said base plate such that said casters roll across said base plate when said turntable is being rotated with respect to said base plate.

* * * * *